US006732719B2

(12) United States Patent
Mitsutani

(10) Patent No.: US 6,732,719 B2
(45) Date of Patent: May 11, 2004

(54) VAPORIZED FUEL PURGE CONTROLLER FOR ENGINE

(75) Inventor: Noritake Mitsutani, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/453,780

(22) Filed: Jun. 4, 2003

(65) Prior Publication Data

US 2003/0226550 A1 Dec. 11, 2003

(30) Foreign Application Priority Data

Jun. 5, 2002 (JP) ..... 2002-164150

(51) Int. Cl.[7] ..... F02M 33/02
(52) U.S. Cl. ..... 123/520; 123/519
(58) Field of Search ..... 123/519, 520, 123/518, 510

(56) References Cited

U.S. PATENT DOCUMENTS 5,520,160 A * 5/1996 Aota et al. ..... 123/675
6,505,599 B1 * 1/2003 Mashiki et al. ..... 123/295

FOREIGN PATENT DOCUMENTS

| | | |
|---|---|---|
| JP | 6-93900 A | 4/1994 |
| JP | 7-243339 A | 9/1995 |
| JP | 8-28370 A | 1/1996 |
| JP | 8-42739 A | 2/1996 |
| JP | 11-115241 A | 4/1999 |
| JP | 2000-27718 A | 1/2000 |

* cited by examiner

*Primary Examiner*—Bibhu Mohanty
(74) *Attorney, Agent, or Firm*—Kenyon & Kenyon

(57) ABSTRACT

A controller for purging an optimal amount of vaporized fuel in accordance with the operating conditions of an engine. The controller presumes the flow rate of the purged gas to be that when a purge valve is fully opened and uses the presumed value to calculate a target flow rate ratio. The controller than uses the target flow rate ratio and the actual intake pressure to calculate a duty ratio. This achieves a purged gas flow rate which compensates for a deviation that results from a characteristic of the purge valve.

19 Claims, 5 Drawing Sheets

VAPORIZED FUEL PURGE CONTROLLER FOR ENGINE

BACKGROUND OF THE INVENTION

The present invention relates to a vaporized fuel purge controller for an engine that purges vaporized fuel, which is produced in a fuel tank and adsorbed in a canister, into an intake passage of the engine.

Japanese Laid-Opened Patent Publication No. 6-93900 describes a first prior art example of a vaporized fuel purge controller. In the first prior art example, the purged amount of the vaporized fuel is adjusted by changing the duty ratio of a drive signal, which drives a purge valve arranged between a canister and an intake passage. The duty ratio is calculated in accordance with characteristics of the purge valve.

When the drive voltage of the purge valve decreases in the duty-controlled purge valve, the amount that the purge valve opens relative to the duty ratio changes. In this case, the same flow rate of vaporized fuel may not be obtained even though the purge valve is controlled with the same duty ratio.

When there is a delay in the timing in which the purge valve is opened, a compensation duty ratio is added to the basic duty ratio to compensate for the delay. The purge valve drive voltage (battery voltage) and temperature are referred to when determining the compensation duty ratio. The compensation duty ratio increases as the purge valve drive voltage (battery voltage) decreases and increases as the temperature of the purge valve increases.

FIG. 8 is a graph used to calculate the duty ratio of the drive signal from the target flow rate ratio of the purged gas. The duty signal is sent to the purge valve to duty-control the purge valve. The ideal duty characteristic of the purge valve would be plotted along line La having a slope of 1 in which the duty ratio is 100% (purge valve being fully opened) when the target purged gas flow rate ratio is 100%.

However, electric response delays occur in the actual purge valve. This produces an invalid activation time (valve opening delay) from when the purge valve is activated to when the purge valve starts to open. Thus, the target purged gas flow rate ratio is not achieved even when the purge valve is driven under a duty ratio that is in the vicinity of 0%. Accordingly, in the prior art, a predetermined minimum duty ratio is set. Line Lb1, which is shown in FIG. 8, is used so that a duty ratio that is lower than the minimum duty ratio is not used. In line Lb1, the duty ratio is 0% when the invalid activation time ends.

In this specification, the term "purging rate" refers to the percentage (%) of the amount of purged gas relative to the amount of intake air flowing through the intake passage. The term "vapor concentration" refers to the percentage (%) of the vaporized fuel included in the purged gas when the purging rate is 1%. The term "target purged gas flow rate ratio" refers to the percentage (%) of the target purged gas flow rate relative to the flow rate of the purged gas when the purge valve is fully opened.

In an engine provided with a vaporized fuel purge controller, changes in the operating conditions of the engine, such as intake pressure, affects the linearity of the relationship between the target purged gas flow rate ratio and the duty ratio. When the linearity of the relationship is lost, the actual purged gas flow rate does not match the target purged gas flow rate. This has an undesirable influence on the purge control air-fuel ratio control.

Referring to FIG. 9, when there is a change in an operating condition of the engine, such as the intake pressure, the duty ratio and the purged gas flow rate ratio (purged gas flow rate/purged gas flow rate when purge valve is fully opened) deviate from their targets (curves Lb2 and Lb3). Due to such a decrease in the flow rate linearity, even if the purge valve is driven using the target duty ratio that is determined in correspondence with the target purged gas flow amount, a purged gas flow rate corresponding to the target duty ratio is not obtained. As a result, the requirements of various types of controls in the engine are not satisfied (i.e., purge control capability decreases). Further, the actual purged gas flow rate deviates from the flow rate that is expected from the target duty ratio. Thus, the vapor concentration that is expected by analysis deviates from the actual vapor concentration. As a result, the actual purged gas flow rate is not accurately predicted and the air-fuel ratio control capability decreases.

This problem is more prominent when employing a purge valve having a valve body that closes the purge valve with a larger force as the intake pressure decreases (as the intake negative pressure increases). Such a purge valve has a characteristic in which it becomes difficult to close the valve at low duty ratios as the difference between the intake pressure (i.e., the pressure at a location immediately downstream of the purge valve) and the atmospheric pressure (i.e., the pressure at a location immediately upstream of the purge valve) increases. Due to this characteristic, it becomes difficult to obtain a purged gas flow rate corresponding to the duty ratio. This tendency becomes prominent when the drive voltage decreases.

The above problem also occurs when employing an electromagnetic valve (hereafter referred to as solenoid type purge valve) that is controlled in accordance with the current value of the drive signal. This is because a change in the intake pressure causes the actual opened amount of the purge valve to deviate from the target opened amount.

The deviation of the duty ratio from the flow rate ratio (i.e., decrease in the flow rate linearity), which results from changes in the operating condition of the engine, also occurs when employing a duty control type purge valve or solenoid type purge valve. These valves have a characteristic in which the opened amount of the purge valve increases as the negative intake pressure increases. In each valve, as the negative intake pressure increases, a force that is applied to the valve body in a direction closing the valve decreases.

Further, in the first prior art example, due to electric response delays when activating or deactivating the purge valve, the relationship between the purged gas flow rate ratio and the duty ratio is as shown by curve Lb4 in FIG. 10. Changes in the purged gas flow rate ratio decreases when the duty ratio is in the proximity of 0%, and changes in the purged gas flow rate ratio increases when the duty ratio is in the proximity of 100%. Thus, even if the influence of the invalid activation time is corrected, the actual purged gas flow rate cannot be accurately calculated based on the ideal line La. As a result, the fuel injection amount cannot be accurately corrected. This has an undesirable effect on air-fuel ratio control.

Japanese Laid-Opened Patent Publication 2000-27718 describes a second prior art example. In the second prior art example, the opened amount of the purge valve is determined by referring to an interpolation value map generated from the intake pressure and the target purged gas flow rate. In the map, the set opened amount of the purge valve decreases as the intake pressure decreases (i.e., negative pressure increases), and the set opened amount of the purge valve also decreases as the target purged gas flow rate decreases. However, as the intake pressure decreases, it becomes difficult for the purge valve closed by negative pressure to open at a low duty ratio. Thus, in the second prior art example, when using such a purge valve, the target purged gas flow rate corresponding to the duty ratio cannot be achieved.

SUMMARY OF THE INVENTION

It is an object of the present invention to provide a vaporized fuel purge controller for an engine that facilitates purge control and air-fuel ratio control and improves drivability.

To achieve the above object, the present invention provides a purge controller for controlling a vaporized fuel processing mechanism in an engine. The vaporized fuel processing mechanism has a canister and a purge valve for controlling flow of purged gas, which includes air and vaporized fuel adsorbed by the canister, into an intake system of the engine. The engine undergoes purge control and air-fuel ratio control, and the purge valve is driven in accordance with the level of a drive signal. The purge controller includes a target level calculating means for calculating a target level of the drive signal. The target level calculating means uses a parameter representing the operating condition of the engine and a predetermined flow rate ratio of purged gas to presume the deviation between the purged gas flow rate ratio and the level of the drive signal that results from a characteristic of the purge valve and calculates the target level in accordance with the presumed deviation.

A further aspect of the present invention is a purge controller for controlling a vaporized fuel processing mechanism of an engine that has an intake passage and undergoes air-fuel control. The vaporized fuel processing mechanism has a purge valve to introduce into the intake passage a controlled amount of purged gas, which includes air and the vaporized fuel, and the purge valve is driven in accordance with the level of a drive signal. The controller includes a sensor for detecting an operating condition of the engine and a computer for calculating a level of the drive signal. The computer presumes a fully opened flow rate of the purged gas introduced into the intake passage which is the purged gas flow rate when the purge valve is fully opened during the present engine operating condition detected by the sensor. The computer also calculates a ratio between the presumed fully opened flow rate and a target flow rate designated by the air-fuel control. Further, the computer calculates the level of the drive signal based on the ratio and the present engine operating condition.

A further aspect of the present invention is a purge control method for controlling a vaporized fuel processing mechanism of an engine that has an intake passage and undergoes air-fuel control. The vaporized fuel processing mechanism has a purge valve to introduce into the intake passage a controlled amount of purged gas, which includes air and vaporized fuel. The purge valve is driven in accordance with the level of a drive signal. The method includes detecting a present operating condition of the engine, presuming a fully opened flow rate of the purged gas introduced into the intake passage, which is the purged gas flow rate when the purge valve is fully opened during the present engine operating condition, calculating a ratio between the presumed fully opened flow rate and a target flow rate designated through the air-fuel control, calculating a level of the drive signal from the ratio and the present engine operating condition, and providing the purge valve with drive signal having the calculated level.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A vaporized fuel purge controller according to a preferred embodiment of the present invention will now be discussed. Hereinafter, the term "purge valve characteristic" refers to a characteristic in which how easily the valve opens in accordance with the intake pressure of an engine 10.

Figure 1:
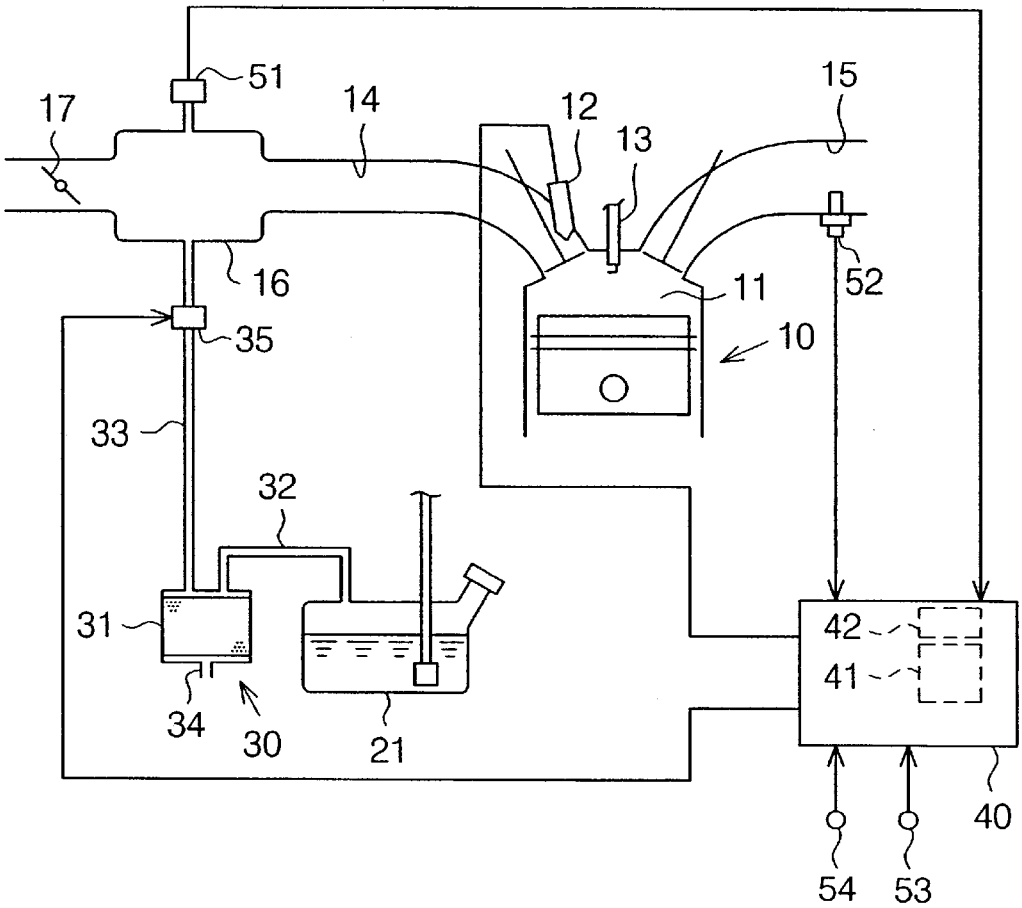
FIG. 1 is a schematic diagram of a vaporized fuel purge controller according to a preferred embodiment of the present invention.

The engine 10 for which the vaporized fuel purge controller is used will now be described. Referring to FIG. 1, the engine 10 includes a fuel injection valve 12 and an ignition plug 13. The fuel injection valve 12 injects fuel, which is supplied from a fuel tank 21 through a fuel supply passage (not shown), into a combustion chamber 11. The ignition plug 13 ignites the mixture of the injected fuel and the intake air. The combustion chamber 11 is connected to an intake passage 14 and an exhaust passage 15. A surge tank 16 is arranged in the intake passage 14. A throttle valve (electronically controlled) 17 is arranged upstream of the surge tank 16 to adjust the intake air amount.

The engine 10 includes a vaporized fuel processing mechanism 30. The vaporized fuel processing mechanism 30 includes a canister 31, which is connected to the fuel tank 21 though a vapor passage 32, a purge passage 33, which is connected to the canister 31 and the surge tank 16, an ambient air passage 34, through which ambient air is drawn, and a purge valve 35, which is arranged in the purge passage 33.

Vaporized fuel produced in the fuel tank 21 is drawn into the canister 31 from the fuel tank 21 through the vapor passage 32 and adsorbed by an adsorbent, which is arranged in the canister 31. By opening the purge valve 35 and drawing ambient air into the canister 31 through the ambient air passage 34, the fuel adsorbed in the adsorbent is purged (released) into the surge tank 16 through the purge passage 33 together with the air. The fuel and air form purged gas. The fuel in the purged gas is burned in the combustion chamber 11 with the fuel injected from the fuel injection valve 12.

The purge valve 35 adjusts the flow rate of the purged gas entering the surge tank 16. The duty ratio (level) of the electric drive signal adjusts the opened amount of the purge valve 35 (the ratio of the time the purge passage 33 is opened or the ratio of the opened area of the purge passage 33). The purge valve 35, which is closed by negative intake pressure, has a valve body. As the intake pressure increases (as the absolute pressure decreases), a force pushing the valve body in a direction closing the purge valve 35 increases.

An electronic control unit (ECU) 40 performs purge control of the engine 10 and air-fuel ratio control with the fuel injection valve 12 in a centralized manner. The ECU 40 includes a memory 41, which stores programs, calculation maps, and calculation data for executing various types of control, and a computer 42, which executes the programs. Various types of sensors, which detect the operating conditions of the engine 10, are connected to the ECU 40 to provide the ECU 40 with detection signals generated by the sensors. The ECU 40 performs various kinds of controls, including the purge control and air-fuel ratio control.

The ECU 40 is provided with detection signals from, for example, a pressure sensor 51, which detects the pressure of the surge tank 16 (intake pressure), an oxygen sensor 52, which is arranged in the exhaust passage and which detects the concentration of oxygen in the burned gas to calculate the air-fuel ratio of the air-fuel mixture, a speed sensor 53, which detects the engine speed of the engine 10, and an acceleration pedal sensor 54, which detects the depressed amount of an acceleration pedal (not shown). The operating conditions of the engine 10 and the driving conditions of the vehicle are determined from the detection signals of the sensors 51 to 54. Purge control and air-fuel ratio control are performed in accordance with the operating conditions of the engine 10 and the driving conditions of the vehicle.

Air-fuel ratio control is performed by feedback-controlling the amount of fuel injected from the fuel injection valve 12 in accordance with the detection signal of the oxygen sensor 52 so that the ratio of the intake air amount relative to the fuel injection amount relative (weight ratio), or the air-fuel ratio (A/F), is basically maintained at the theoretical air-fuel ratio.

The purge control will now be discussed.

The vapor concentration is not available immediately after the engine 10 is started. Thus, the opened amount of the purge valve 35 is gradually increased. This is to prevent the median of the air-fuel control (A/F) or the median of the air-fuel ratio feedback control (F/B) from deviations caused by suddenly opening the purge valve 35. The opened amount of the purge valve 35 increases at a speed enabling changes in the air-fuel ratio to be followed. In this manner, the initial vapor concentration is determined, and the vapor concentration is also determined.

As long as the purging rate is available, the deviation of the A/F median or the F/B median (deviation from control median 1.0) may be checked from changes in the detection signals. That is, if the amount of the A/F median and F/B median is deviated even when the amount of the supplied purge gas is available, it is presumed that the determined vapor concentration is deviated from the actual vapor concentration when updating the determined value of the vapor concentration. As long as the oxygen sensor has a linear characteristic, the A/F median may be obtained from the deviation of the vapor concentration. If the oxygen sensor 52 has a non-linear characteristic, the F/B median may be obtained from the deviation of the vapor concentration. Actually, the determined value of the vapor concentration is gradually updated from slight deviations of the A/F median or the F/B median.

When purging is being performed, the amount of fuel included in the purged gas is subtracted from the amount of fuel injected from the fuel injection valve 12. The fuel injection amount is normally corrected by adjusting the time during which the fuel injection valve 12 is opened. The ECU 40 calculates the amount of fuel in the purged gas from the determined vapor concentration at predetermined time intervals. Further, the ECU 40 calculates the time required to inject the corrected amount of fuel.

The purge control will now be discussed in detail with reference to FIGS. 2 to 7.

Figure 2:
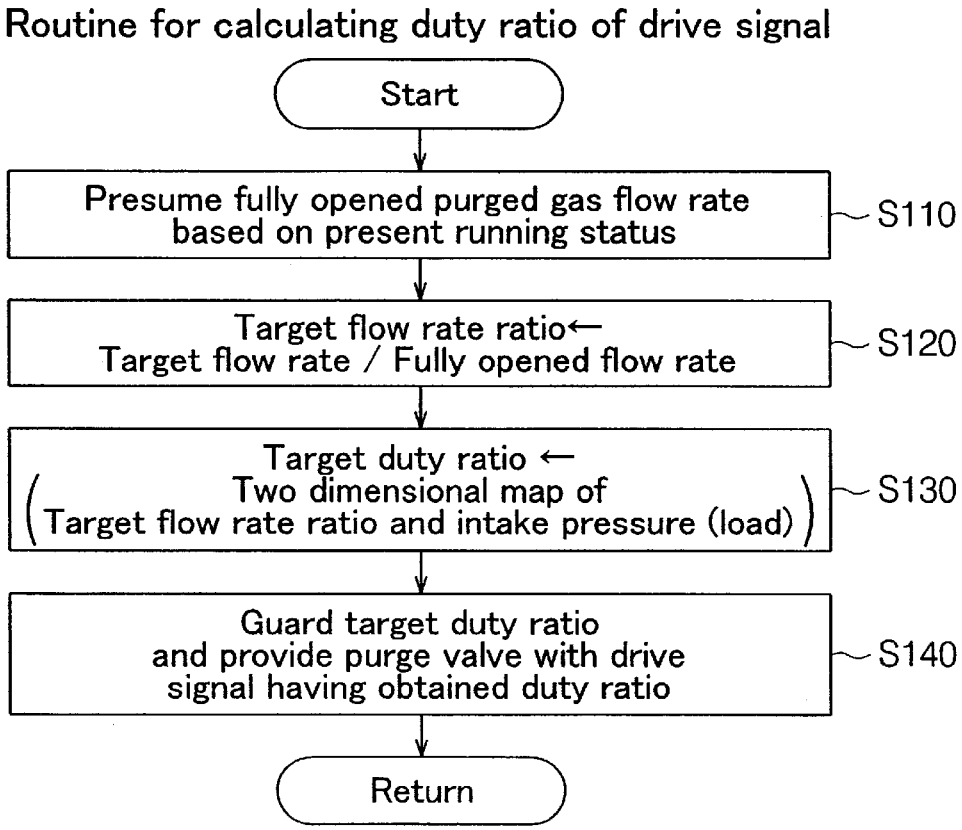
FIG. 2 is a flowchart illustrating a routine executed by the vaporized fuel purge controller to calculate the duty ratio of a purge valve drive signal.

The ECU 40 executes a routine illustrated in FIG. 2 to calculate the duty ratio of the drive signal in interrupts at predetermined time intervals.

First, in step S110, the ECU 40 presumes a fully opened purged gas flow rate from the present operating conditions of the engine 10. The fully opened purged gas flow rate refers to the flow rate of the purged gas when the purge valve 35 is fully opened. Further, the fully opened purged gas flow rate is obtained from a parameter representing the operating condition of the engine 10, such as the engine speed or the load rate, and a purged gas flow rate map (not shown). Accordingly, the operating conditions of the engine 10 are taken into consideration when obtaining the presumed fully opened purged gas flow rate.

In step S120, the ECU 40 calculates a target purged gas flow rate ratio by dividing a target purged gas flow rate by the fully opened purged gas flow rate obtained in step S110.

The target purged gas flow rate is determined from the purging rate, that is, the ratio of the purged gas in the intake air. The purging rate is determined in accordance with requirements for performing various controls, such as control for suppressing the discharge of vaporized fuel into the atmosphere. The purging rate may be determined in step S120 or through another routine. The target purged gas flow rate is calculated from the present intake air amount and the purging rate. In this manner, the target purged gas flow rate ratio is calculated from the fully opened purged gas flow rate, which is presumed in accordance with the present engine operating condition, and the target purged gas flow rate, which is determined in accordance with the purging rate.

In step S130, the ECU 40 refers to a predetermined two-dimensional map (FIG. 3), which shows the relationship between the target purged gas flow rate ratio and the intake pressure (load), to obtain a duty ratio (target duty ratio) of a drive signal, which drives the purge valve 35. In the two-dimensional map, values are registered so that the varied amount of the purged gas flow rate ratio relative to the varied amount of the duty ratio is greater as the intake pressure increases (i.e., as the load decreases). Accordingly, the target duty ratio is set so that in a low duty ratio range, a greater amount of purged gas flows as the intake pressure increases. The target duty ratio is also set so that in the low duty ratio, the ratio between the varied amount of the duty ratio and the varied amount of the purged gas flow rate ratio is close to the value of "1".

In this manner, the deviation between the purged gas flow rate ratio and the duty ratio is presumed from the actual intake pressure and the target purged gas flow rate ratio. Then, the target duty ratio is calculated in accordance with the presumed deviation. That is, in steps S110 to S130, the target duty ratio is calculated in accordance with the characteristics of the purge valve 35 and the present operating conditions of the engine 10. This facilitates purge control.

The improved purge control characteristic is especially effective when employing the duty-controlled purge valve 35, which is closed by negative pressure. More specifically, the influence of the intake pressure is compensated for in the target duty ratio even when the purge valve 35, which is closed by intake pressure, is controlled at a low duty ratio. Thus, the predetermined purged gas flow rate ratio is obtained.

After calculating the target duty ratio, in step S140, the ECU 40 performs various types of guard processes to maintain the calculated target duty ratio in a predetermined range. Then, the ECU 40 drives the purge valve 35 with the drive signal that is in accordance with the target duty ratio subsequent to the processing. After performing step. S140, the ECU 40 temporarily ends the routine.

Step 130 serves as a target level calculating step, and the ECU 40 serves as a target level calculating means.

Figure 4:
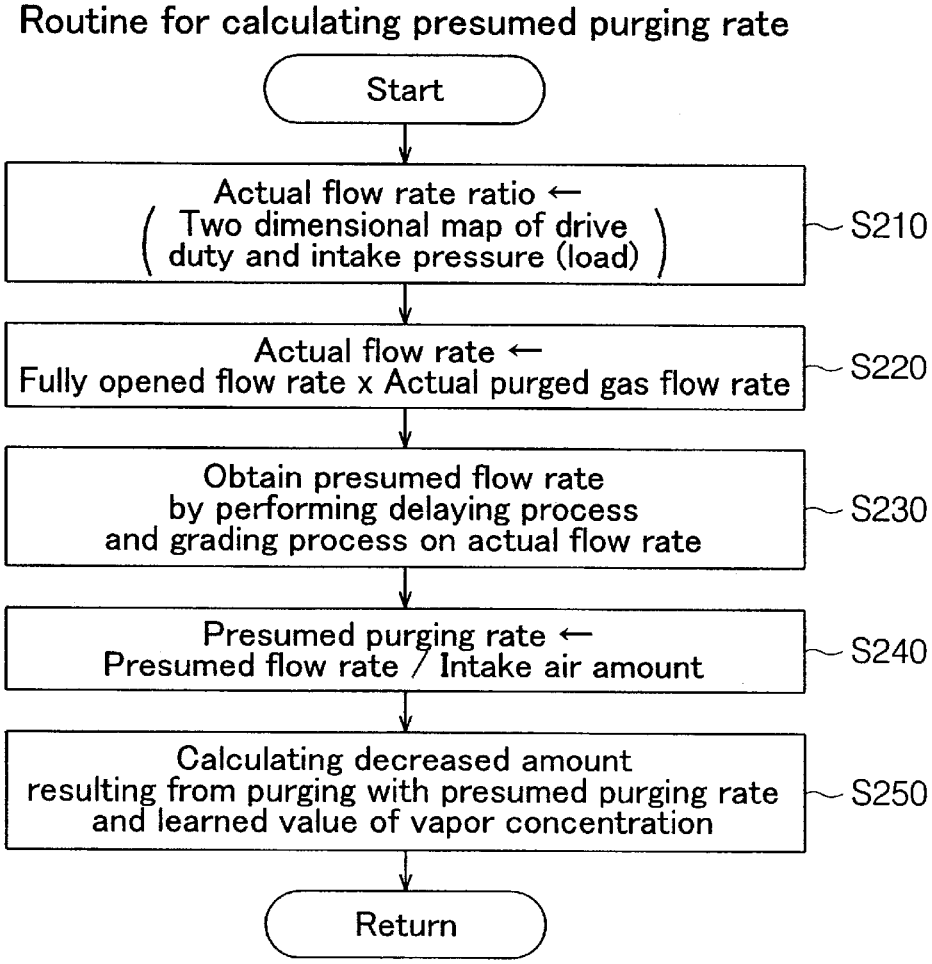
FIG. 4 is a flowchart illustrating a routine executed by the vaporized fuel purge controller to calculate a presumed purging rate.

FIG. 4 is a "presumed purging rate calculating routine", which is performed in interrupts at predetermined time intervals.

Figure 5:
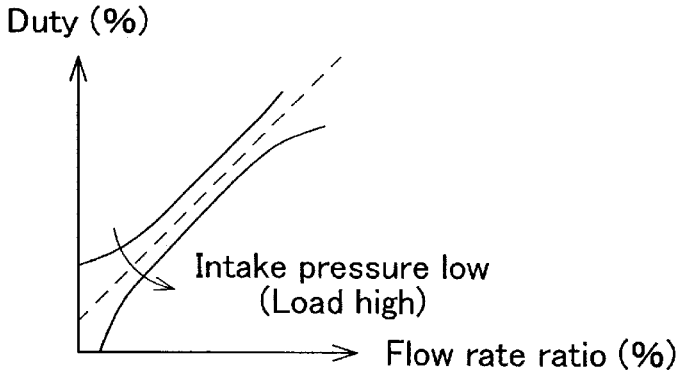
FIG. 5 is a map used in the routine of FIG. 4.

In step S210, the ECU 40 sets a two-dimensional map, which is shown in FIG. 5, and uses the map to obtain the actual purged gas flow rate ratio when the purge valve 35 is driven. The intake pressure (load) changes during the period in which the purge valve 35 is driven to its target opened amount. Accordingly, the actual purged gas flow rate does not match the flow rate corresponding to the target duty ratio. Therefore, in step S210, the ECU 40 obtains the actual purged gas flow rate ratio from the two-dimensional map of the duty ratio and the intake pressure (load).

In the two-dimensional map of FIG. 5, for a low duty ratio, the varied amount of the duty ratio relative to the varied amount of purged gas flow rate ratio decreases as the intake pressure increases, that is, as the load decreases. Further, the two-dimensional map is set so that the varied amount of the duty ratio relative to the varied amount of purged gas flow rate ratio is larger as the intake pressure decreases, that is, as the load increases. The relationship between the purged gas flow rate ratio and the duty ratio, that is, the varied amount of the duty ratio relative to the varied amount of the purged gas flow rate ratio is set so that their values are plotted along a straight line having a slope of "1".

Figure 3:
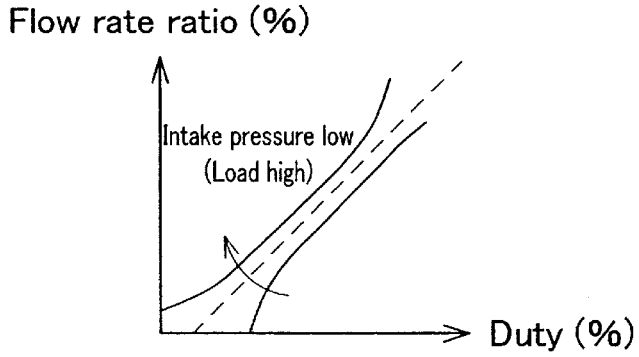
FIG. 3 is a map used in the routine of FIG. 2.

The maps of FIGS. 3 and 5 are generated from data representing the relationship between the purged gas flow rate ratio and the intake pressure (load). The map of FIG. 5 is generated by exchanging the horizontal and vertical axes of those in the map of FIG. 3. Therefore, instead of generating the two maps, only one map may be generated. The generation of one map or two maps depends upon calculation conditions.

In this manner, in step S210, the ECU 40 calculates the actual purged gas flow rate ratio, which compensates for the deviation of the purged gas flow rate ratio corresponding to the calculated duty ratio from the target purged gas flow rate that results from the characteristics of the purge valve 35.

In step S220, the actual purged gas flow rate ratio and the calculated fully opened purged gas flow rate are multiplied to calculate the actual purged gas flow rate.

In steps S210 and S220, the ECU 40 uses the duty ratio and the engine operating conditions, such as the engine speed and the load rate. Accordingly, the deviations of the purged gas flow rate ratio and the duty ratio resulting from the characteristics of the purge valve 35 are compensated for.

Steps S210 and S220 serve as a step for calculating the actual purged gas flow rate. The ECU 40 serves as a means for calculating the actual purged gas flow rate.

There is a time lag from when gas is purged to the surge tank 16 to when the purged gas reaches the combustion chamber 11. In step S230, a presumed flow rate that takes into consideration the time lag of the purged gas is obtained by performing a delaying process and a grading process on the actual purged gas flow rate calculated in step S220. In other words, whenever fuel is injected, the presumed flow rate is calculated from the purge timing, the time required for the purged gas to reach the combustion chamber 11, and the actual purged gas flow rate. The degree of the time lag depends on the pumping effect of the engine 10, or the engine speed.

In step S240, the ECU 40 divides the presumed flow rate by the intake air amount to calculate the presumed purging rate.

In step S250, the presumed purging rate is added to the determined value of the vapor concentration to calculate a decreased amount (decrease resulting from purging) of the injected fuel. An amount of fuel that is less by the calculated amount is injected.

Figure 6:
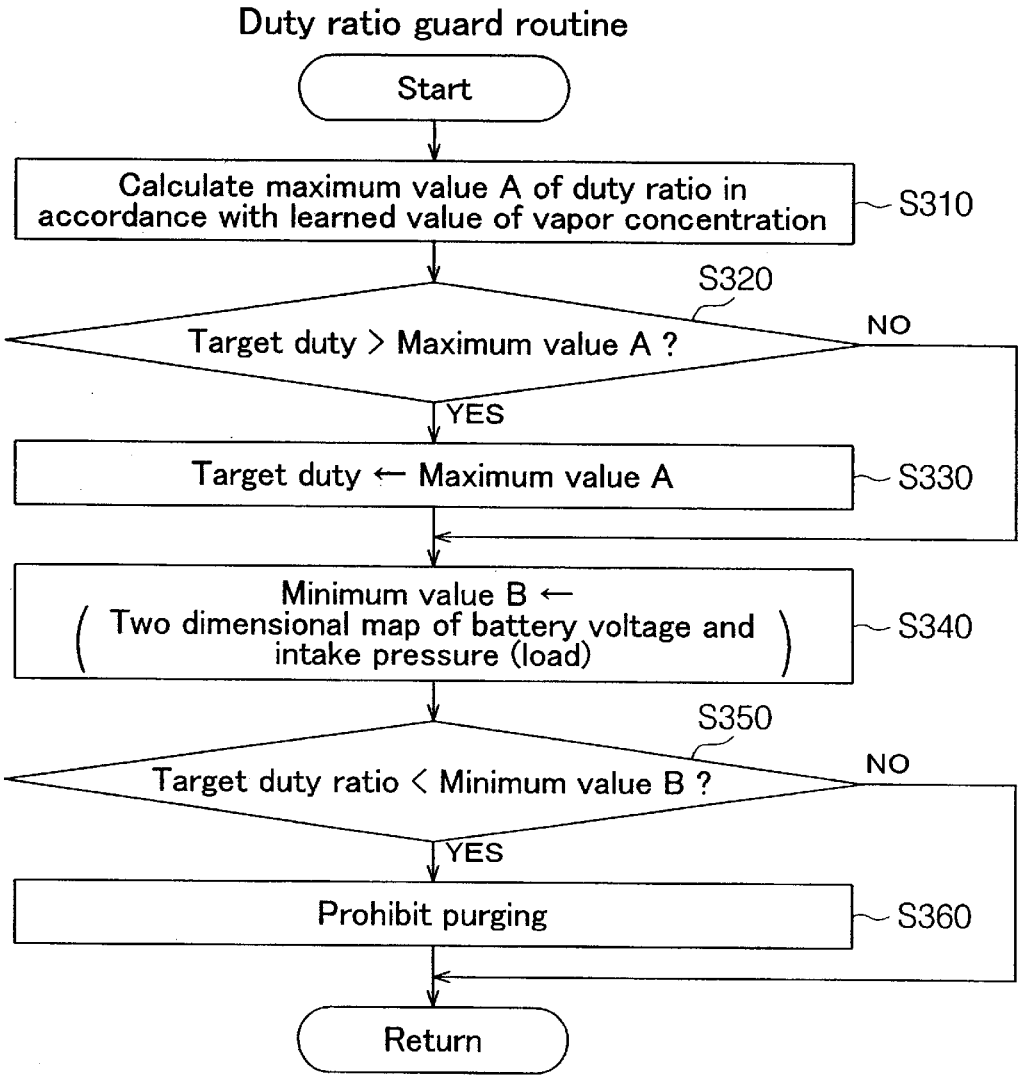
FIG. 6 is a flowchart illustrating a duty guard routine executed by the vaporized fuel purge controller.

Referring to FIG. 6, a "duty ratio guard routine" performed by the ECU 40 in interrupts at predetermined time intervals will now be discussed.

In step S310, the ECU 40 calculates a maximum duty ratio in accordance with the determined value of the vapor concentration. For example, the maximum duty ratio A that is in accordance with the determined value of the vapor concentration is calculated so the surge tank 16 is not provided with a large amount of rich vaporized gas, in which the decreased amount is 40% or greater of the fuel injection amount.

In step S320, the ECU 40 determines whether the target duty ratio calculated in step S130 is greater than the maximum duty ratio A. When the target duty ratio is greater than the maximum duty ratio A (YES in step S320), in step S330, the ECU 40 sets the maximum duty ratio A as the target duty ratio. If the target duty ratio is less than or equal to the maximum duty ratio A, the ECU 40 skips step S330.

Figure 7:
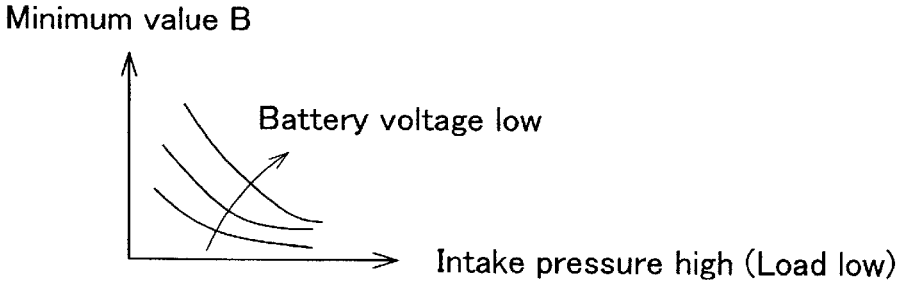
FIG. 7 is a map used in the routine of FIG. 6.
Figure 8:
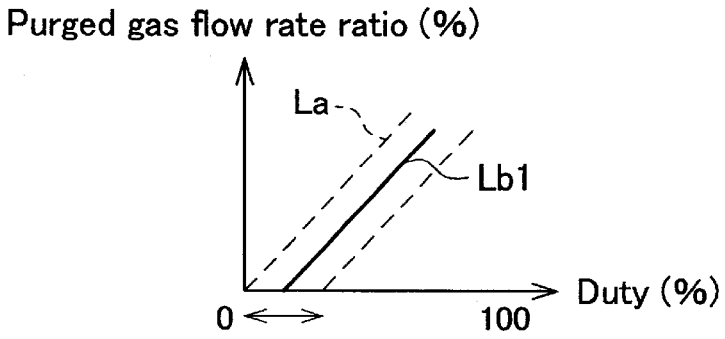
Fig.8(Prior Art)
FIG. 8 is a graph used to calculate the duty ratio of a purge valve from a target flow rate ratio in the prior art.
Figure 9:
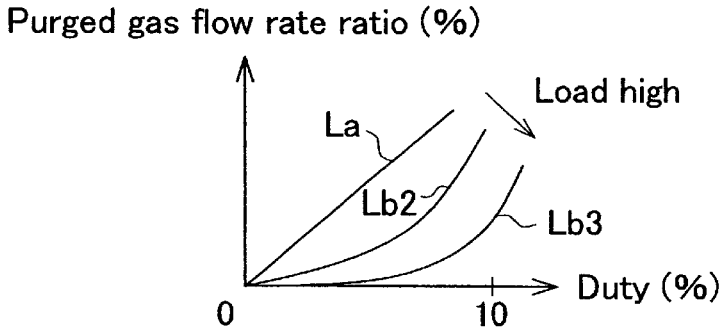
FIG. 9 is a graph illustrating the flow rate characteristic of a purge valve that is varied when the negative pressure increases in the prior art.
Figure 10:
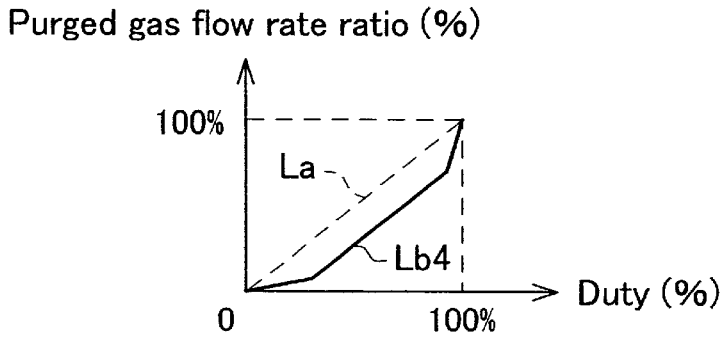
FIG. 10 is a graph illustrating the flow rate characteristic of a purge valve closed by negative pressure in the prior art.

In step S340, the ECU 40 refers to the two-dimensional map of FIG. 7 to set the minimum value (linearity minimum value) B of the target duty ratio. As the battery wears out and decreases the drive voltage, it becomes difficult to open the purge valve 35. It also becomes difficult to open the purge valve 35 when the intake pressure is high (load is small). Thus, as shown in FIG. 7, the minimum value B registered in the map increases as the battery voltage decreases and the load decreases (i.e., as the intake pressure increases).

In step S350, the ECU 40 determines whether the target duty ratio is less than the minimum value B. If the target duty ratio is less than the minimum value B (YES in step S350), the ECU 40 proceeds to step S360 and prohibits purging. If the target duty ratio is greater than or equal to the minimum value B (NO in step S350), the ECU 40 temporarily ends the routine.

In this manner, in the duty guard routine of FIG. 6, the minimum value B fluctuates in accordance with the battery voltage and the intake voltage. Thus, the linearity of the target flow rate ratio and the target duty ratio is maintained within the proper range.

Step S340 serves as a step for calculating the minimum value, and the ECU 40 serves as a means for calculating the minimum value.

The preferred embodiment has the advantages described below.

In the routine of FIG. 2, the target flow rate ratio is calculated using the presumed fully opened purged gas flow rate. The deviations of the purged gas flow rate ratio and the duty ratio resulting from the characteristics of the purge valve 35 are presumed from the actual intake pressure and the target flow rate ratio. Further, the target duty ratio (target level of the drive signal) is calculated in accordance with the deviations. Thus, the purged gas flow rate is obtained in accordance with the target duty ratio. That is, fluctuations in the flow rate characteristics resulting from changes in the difference between the pressure of the inlet and outlet of the purge valve 35, or changes in the intake pressure, are compensated for. This improves the purge control characteristic, the air-fuel ratio control characteristic, and the drivability.

In the routine of FIG. 4, the actual purged gas flow rate is calculated using the presumed fully opened purged gas flow rate. That is, when calculating the actual purged gas flow rate, the deviations of the purged gas flow rate ratio and the duty ratio are compensated for by using the actual intake pressure and the fully opened purged gas flow rate. Thus, even if a delay in the electric response of the purge valve 35 significantly changes the flow rate ratio when the duty ratio is in the proximity of 0% and 100%, the actual purged gas flow rate is accurately obtained. This improves the accuracy for calculating the presumed purging rate, the air-fuel control characteristics, and the drivability.

In the two-dimensional map of FIG. 3, the varied amount of the purged gas flow rate ratio relative to the varied amount of the duty ratio is greater as the intake pressure increases. In step S130 of FIG. 2, the target duty ratio is obtained from the two dimensional map. Thus, when the duty-controlled purge valve 35, which is closed by negative pressure, is employed, the purged gas flow rate is obtained in accordance with the duty ratio even if the duty ratio is low.

Further, as the intake pressure decreases (as the load increases), at a low duty ratio, the varied amount of the purged gas flow rate ratio relative to the varied amount of the duty ratio decreases. Thus, the flow rate characteristic becomes close to a straight line having a slope of "1". This guarantees the flow rate linearity of the duty ratio. Accordingly, even when employing a duty-controlled purge valve, which is closed by negative pressure, changes in the flow rate characteristic resulting from changes in the engine operating condition are suppressed. Further, the purge control characteristic, the air-fuel ratio characteristic, and the drivability are improved.

In step S210 of FIG. 4, the actual purged gas flow rate ratio is calculated from the two-dimensional map of FIG. 5. In the two-dimensional map, at low duty ratios, duty ratios are registered having a small amount of variation relative to the amount of variation of the purged gas flow rate ratio. Accordingly, when employing the purge valve 35 that is closed by negative pressure, the actual purged gas flow rate is accurately calculated. Thus, the presumed purging rate calculation accuracy, the purge control characteristic, the air-fuel ratio control characteristic, and the drivability are improved.

In step S340 of FIG. 6, the minimum value B of the duty ratio fluctuates in accordance with the battery voltage and the intake pressure. Thus, the actual purged gas flow rate is accurately calculated, and the presumed purging rate is calculated with high accuracy. Thus, in comparison with, for example, when determining the minimum value based on only the battery voltage, the air-fuel ratio control characteristic and the drivability are improved.

In the map of FIG. 7, the minimum value B increases as the battery voltage decreases and the intake pressure increases (load decreases). Since the optimal minimum value B is set in accordance with the battery voltage and the intake voltage, the range in which the relationship between the duty ratio and the flow rate is linear may be fully utilized. Since the minimum value B increases as the intake pressure increases, even when employing the purge valve 35, which is closed by negative pressure, the range in which the relationship between the duty ratio and the flow rate is linear may be fully utilized.

It should be apparent to those skilled in the art that the present invention may be embodied in many other specific forms without departing from the spirit or scope of the invention. Particularly, it should be understood that the present invention may be embodied in the following forms.

Instead of using a duty-controlled electromagnetic valve, a solenoid type valve may be employed as the purge valve 35. In this case, the current of a drive signal provided to the solenoid type valve is processed.

Although the purge valve 35 is a valve that becomes more difficult to open at higher negative intake pressures, the present invention is not limited to such structure. For example, the deviations of the duty ratio and the purged gas flow rate ratio resulting from changes in the engine operating conditions, such as the intake pressure (decrease in the linearity of the flow rate), may be applied when employing a duty-controlled purge valve, which becomes difficult to open at higher negative intake pressures, or a solenoid type purge valve.

In the maps of FIGS. 3, 5, and 7, instead of using the intake pressure as one of the parameters indicating the engine operating condition, other parameters closely related to the intake pressure may be used.

The present examples and embodiments are to be considered as illustrative and not restrictive, and the invention is not to be limited to the details given herein, but may be modified within the scope and equivalence of the appended claims.

What is claimed is:

1. A purge controller for controlling a vaporized fuel processing mechanism in an engine, wherein the vaporized fuel processing mechanism has a canister and a purge valve for controlling flow of purged gas, which includes air and vaporized fuel adsorbed by the canister, into an intake system of the engine, wherein the engine undergoes purge control and air-fuel ratio control, and the purge valve is driven in accordance with the level of a drive signal, the purge controller comprising:

a target level calculating means for calculating a target level of the drive signal, wherein the target level calculating means uses a parameter representing an operating condition of the engine and a predetermined target flow rate ratio of purged gas to presume the deviation from the purged gas flow rate ratio and the level of the drive signal that results from a characteristic of the purge valve and calculates the target level in accordance with the presumed deviation.

2. The purge controller according to claim 1, further comprising:

a flow rate calculating means for calculating actual flow rate of the purged gas that flows through the purge valve when the purge valve is being driven, wherein the flow rate calculating means uses the operating condition of the engine and the level of the drive signal to compensate for the deviation from the purged gas flow rate ratio and the level of the drive signal to calculate the actual flow rate of the purged gas.

3. The purge controller according to claim 1, wherein the purge valve is a duty-controlled purge valve that adjusts flow rate in accordance with duty, and the target level is a duty ratio of the drive signal.

4. The purge controller according to claim 3, further comprising:

a memory for storing a map that is set so that, in a relatively low duty ratio range, variation amount of the purged gas flow rate ratio relative to variation amount of the duty ratio increases as intake pressure of the engine increases, wherein the target level calculating means refers to the map to obtain the duty ratio for the drive signal.

5. The purge controller according to claim 3, wherein the purge valve is a duty-controlled purge valve that adjusts flow rate in accordance with duty, and the target level s a duty ratio of the drive signal, the purge controller further comprising:

a memory for storing a map that is set so that, in a relatively low duty ratio range, variation amount of the purged gas flow rate ratio relative to variation amount of the duty ratio decreases as intake pressure of the engine increases, wherein the flow rate calculating means refers to the map to determine an actual flow rate ratio of the purged gas and calculates an actual flow rate of the purged gas from the obtained flow rate ratio.

6. The purge controller according to claim 1, further comprising a minimum value calculating means for calculating a minimum value of the drive signal from a drive voltage of the purge valve and an intake pressure of the engine.

7. The purge controller according to claim 6, further comprising:

a memory for storing a map that is set so that the minimum value increases as the drive voltage decreases and the minimum value increases as the intake pressure increases, wherein the minimum value calculating means refers to the map to obtain the minimum value.

8. A purge controller for controlling a vaporized fuel processing mechanism of an engine that has an intake passage and undergoes air-fuel control, wherein the vaporized fuel processing mechanism has a purge valve to introduce into the intake passage a controlled amount of purged gas, which includes air and the vaporized fuel, and the purge valve is driven in accordance with the level of a drive signal, the controller comprising:

a sensor for detecting an operating condition of the engine; and a computer for calculating a level of the drive signal, wherein the computer:

presumes a fully opened flow rate of the purged gas introduced into the intake passage which is the purged gas flow rate when the purge valve is fully opened during the present engine operating condition detected by the sensor;

calculates a ratio between the presumed fully opened flow rate and a target flow rate designated by the air-fuel control; and calculates the level of the drive signal based on the ratio and the present engine operating condition.

9. The controller according to claim 8, further comprising:

a memory for storing a first map with a plurality of levels of the drive signal that are determined from the ratio and the present engine operating condition, wherein the computer refers to the first map to calculate the level.

10. The controller according to claim 9, wherein the purge valve is a duty-controlled purge valve that adjusts the amount that the valve opens in accordance with duty ratio, and said level is the duty ratio.

11. The controller according to claim 10, wherein the operating condition is the pressure of the intake passage, the sensor is a pressure sensor for detecting the pressure of the intake passage, and the first map is a two-dimensional map in which variation amount of the purged gas flow rate ratio relative to variation amount of the duty ratio increases as the duty ratio decreases and the pressure of the intake passage increases.

12. The controller according to claim 11, wherein the computer further determines a minimum value of the drive signal from a drive voltage for driving the purge valve and the pressure of the intake passage.

13. The controller according to claim 12, wherein the memory stores a second map in which the minimum value increases as the drive voltage decreases and the pressure of the intake passage increases.

14. A purge control method for controlling a vaporized fuel processing mechanism of an engine that has an intake passage and undergoes air-fuel control, wherein the vaporized fuel processing mechanism has a purge valve to introduce into the intake passage a controlled amount of purged gas, which includes air and vaporized fuel, and the purge valve is driven in accordance with the level of a drive signal, the method comprising:

detecting a present operating condition of the engine;

presuming a fully opened flow rate of the purged gas introduced into the intake passage, which is the purged gas flow rate when the purge valve is fully opened during the present engine operating condition;

calculating a ratio between the presumed fully opened flow rate and a target flow rate designated through the air-fuel control;

calculating a level of the drive signal from the ratio and the present engine operating condition; and providing the purge valve with drive signal having the calculated level.

15. The method according to claim 14, further comprising:

preparing a first map with a plurality of levels of the drive signal that are determined from the ratio and the present engine operating condition, wherein said calculating a level of the drive signal includes referring to the first map to calculate the level.

16. The method according to claim 15, wherein the purge valve is a duty-controlled purge valve that adjusts the amount it opens in accordance with a duty ratio, and the level is the duty ratio.

17. The method according to claim 15, wherein the operating condition is the pressure of the intake passage, and the first map is a two-dimensional map in which variation amount of the purged gas flow rate ratio relative to variation amount of the duty ratio increases as the duty ratio decreases and the pressure of the intake passage increases.

18. The method according to claim 17, further comprising:

determining a minimum value of the drive signal from a drive voltage for driving the purge valve and the pressure of the intake passage.

19. The method according to claim 18, further comprising:

preparing a second map in which the minimum value increases as the drive voltage decreases and the pressure of the intake passage increases.

* * * * *